United States Patent [19]

Block et al.

[11] 4,315,136

[45] Feb. 9, 1982

[54] THERMIC DEVELOPING STATIONS

[75] Inventors: Dieter Block, Kiel; Reinhard Gesell, Schoenkirchen; Hans-Werner Peters, Raisdorf, all of Fed. Rep. of Germany

[73] Assignee: Dr. Ing. Rudolf Hell GmbH, Fed. Rep. of Germany

[21] Appl. No.: 99,585

[22] Filed: Dec. 3, 1979

[30] Foreign Application Priority Data

Dec. 2, 1978 [DE] Fed. Rep. of Germany ..... 2852250

[51] Int. Cl.[3] ..... H05B 1/00

[52] U.S. Cl. ..... 219/216; 219/469; 219/530; 354/299; 355/3 FU

[58] Field of Search ..... 219/216, 388, 469, 470, 219/471, 530; 355/106, 107, 3 FU; 354/299, 306, 354; 432/59

[56] References Cited

U.S. PATENT DOCUMENTS

| | | | |
|---|---|---|---|
| 2,921,513 | 1/1960 | Frantz | 355/107 |
| 3,111,040 | 3/1963 | Ishikawa | 354/299 |
| 3,183,819 | 5/1965 | Gordon | 354/299 |
| 3,224,355 | 12/1965 | Thomiszer | 355/106 |
| 3,440,944 | 4/1969 | Endermann et al. | 354/299 |
| 3,628,440 | 12/1971 | Czarnikow et al. | 354/306 |

FOREIGN PATENT DOCUMENTS

| | | | |
|---|---|---|---|
| 2003389 | 1/1970 | Fed. Rep. of Germany | 219/216 |

*Primary Examiner*—Volodymyr Y. Mayewsky
*Attorney, Agent, or Firm*—Hill, Van Santen, Steadman, Chiara & Simpson

[57] ABSTRACT

A thermic developing station for recording material which is to be developed by means of heat, comprising a rotatable drum and a heating element which is adapted to fit the curvature of the drum surface, the recording material being fed through between the drum and the heating element by the drum and at the entrance of the recording material into the heating zone an unheated member is provided which is also adapted to fit the surface of the drum.

11 Claims, 4 Drawing Figures

THERMIC DEVELOPING STATIONS

BACKGROUND OF THE INVENTION

The present invention relates to thermic developing stations for recording material which is to be developed by means of heat of the kind, comprising a rotatable drum and a heating element which is adapted to fit the curvature of the drum surface, the recording material being fed between the drum and the heating element by the drum, wherein at the place of entry of the recording material into the heating zone, an unheated member is provided which is also adapted to fit the curvature of the surface of the drum.

In image recording, to an increasing extent recording material is used which is developed by applying heat. This has the advantage that there is no requirement for the semi-dry developing process needed with the customary photographic material. Thermic developing takes place in such a manner that the exposed recording material is transported, for example by means of an elastic drum, through a heat zone which can consist of a heated half-round surface. The surface is heated to the temperature which is characteristic for the material used, for example 120° to 130° for the presently commercially available dry silver paper. However, at this temperature the layer of emulsion on the paper becomes soft and sticky which causes the recording material to jam and the apparatus to fail. The apparatus becomes operational again only by removing the paper from the developing station or, if necessary, also from the printing station and the feed zone to the developer. Apart from the loss of paper and the downtime of the apparatus, in some applications an added factor is that the recorded image is irretrievably lost which is the case, for example, when images transmitted by radio or received from satellites are being recorded.

SUMMARY OF THE INVENTION

It is an object of the invention to produce an improved thermic developing station which operates reliably and does not have the above-mentioned disadvantages.

Accordingly, the invention consists in a thermic developing station for recording material which is to be developed by means of heat of the kind, comprising a rotatable drum and a heating element which is adapted to fit the curvature of the drum surface, the recording material being fed between the drum and the heating element by the drum wherein, at the place of entry of the recording material into the heating zone, an unheated member is provided which is also adapted to fit the curvature of the surface of the drum.

Advantageously the member is an unheated part of the heating element, and this may be separated from the heated part by a gap to prevent heat conduction therebetween.

BRIEF DESCRIPTION OF THE DRAWING

In order that the invention may be more clearly understood, reference will now be made to the accompanying drawings which show two embodiments thereof by way of example and in which.

DESCRIPTION OF THE PREFERRED EMBODIMENTS

Figure 1:
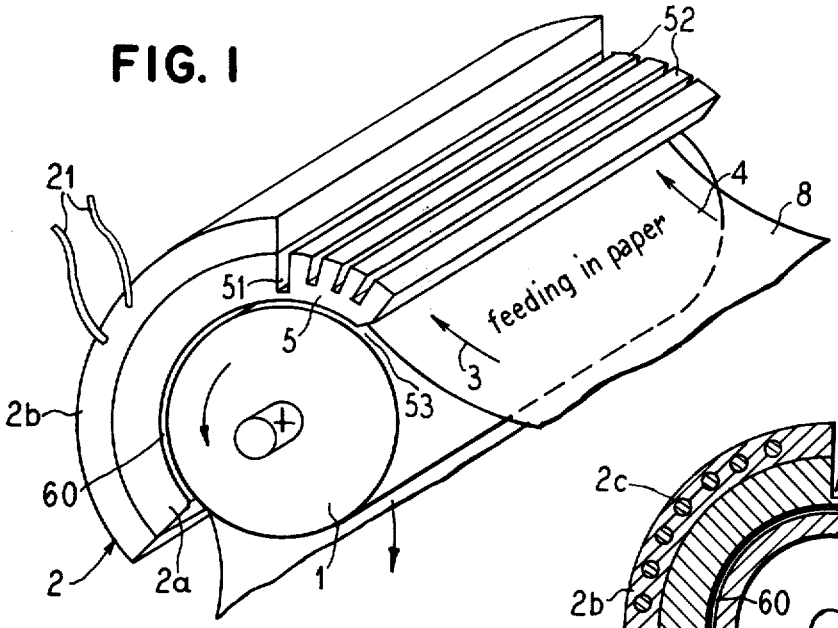
FIGS. 1 and 1A show in perspective and cross sectional views respectively a first embodiment of the invention.
Figure 1A:
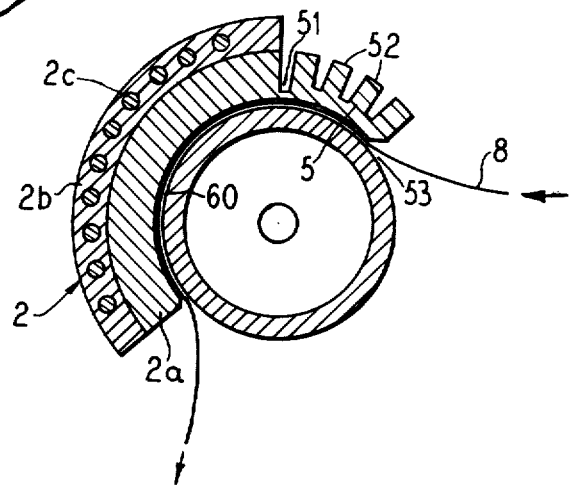

Referring now to the drawings, FIGS. 1 and 1A show a rotatable feed drum 1 and a heating element 2 which is heated, preferably electrically, to the developing temperature which is characteristic for the recording material. The drum 1 and the heating element 2 form a gap 60 through which the recording material 8 is pushed in the direction of arrows 3 and 4 by the rotation of the drum 1.

The electrical heating element 2 is preceded by an unheated member 5 which, like the heating element 2, which has a heater member **2*b* with heating wires 2*c* and leads 21, and a base member 2*a* of thermally conductive material, is adapted to fit the surface curvature of the drum 1. The unheated member 5 and the drum 1 form an additional feed zone. If the recording material becomes stuck in the heating zone, this feed zone, in which the recording material is still cold and cannot stick, ensures that it is fed on reliably in that the recording material is pushed on from this zone. The junction between the unheated member 5 and the heating element 2 is preferably constructed in such a manner that there is no possibility for the recording material to escape. In addition, between the unheated member and the drum, preferably a greater pressure is exerted on the recording material than in the area of the heating zone. As shown in FIG. 1, the member 5 which is substantially less heated than base member 2*a* and which is not directly heated by heater member 2*b*, can be constructed in one piece with the heating element 2 and can be thermally isolated from it by a gap 51. However, instead of the air gap, it can also be thermally isolated from the heating element 2 by means of a different heat insulant. In addition, cooling ribs 52 can be provided which carry away any heat transmitted from the heating element 2. In order to feed in the recording material between the drum 1 and the unheated member 5 in an improved manner a wedge-shaped gap 53** is provided.

Figure 2:
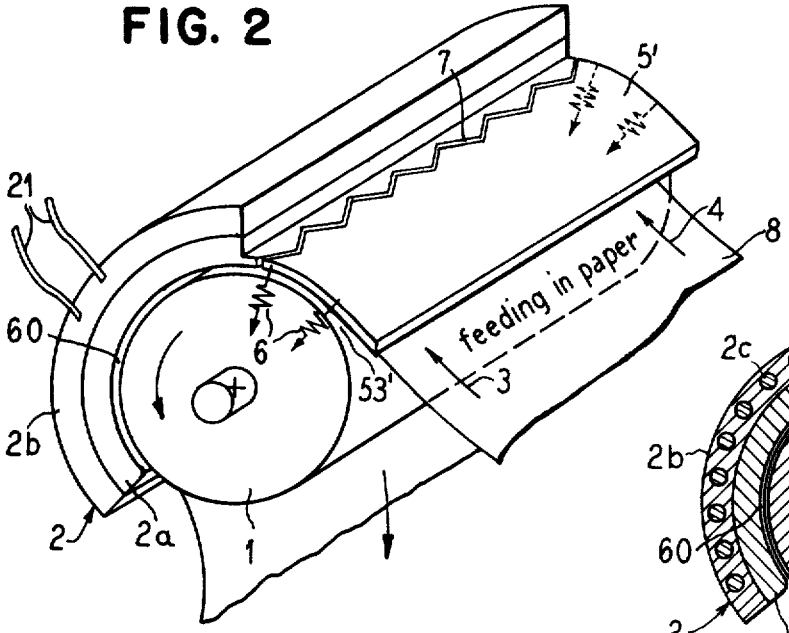
FIGS. 2 and 2A show in perspective and cross sectional views respectively a second embodiment of the invention.
Figure 2A:
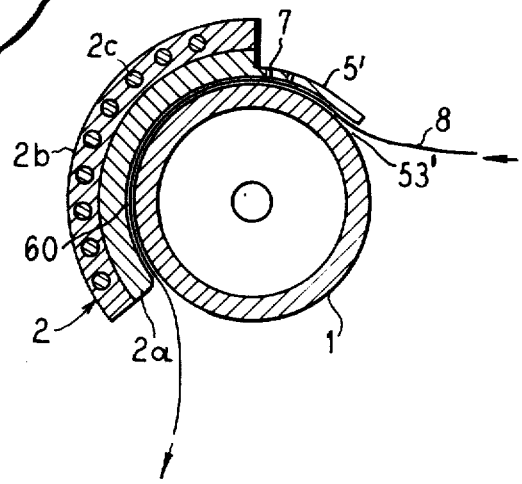

FIGS. 2 and 2A show a second embodiment of the invention, in the form of a plate 5' which is pressed against the drum 1 by means of springs 6. As in FIG. 1, a wedge-shaped gap 53' can be provided and the plate can either be wholly lifted away from the drum 1 or it can also be supported to be rotatable in the area of the heating element 2.

Also shown in FIG. 2 is an indenting saw-tooth shaped junction 7 between the heating element 2 and the plate 5'. This prevents the recording material from escaping from the feed path if the material becomes stuck in the heating zone. The coefficient of friction between the drum and the recording material in the area of the unheated members 5 or 5' is preferably selected to be greater than the coefficient of friction between the recording material and the unheated element. These measures ensure that the recording material will always be advanced reliably.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A thermal development station for recording material to be developed by means of heat, comprising: a rotatable drum; an electrical heating element with an associated directly heated base member having a curved surface corresponding to a curvature of a surface of the drum and being positioned such that a recording material can be transported through by the drum in a gap between the drum and the heating element base member as the drum rotates; and a thermally isolated member which is substantially less heated than portions of the heating element base member likewise having a curved surface corresponding to the curvature of the drum surface and provided at an entry point for the recording material into a heated zone between the drum and the heating element base member.

2. A thermal development station according to claim 1 wherein the thermally isolated member comprises a substantially non-heated extension of said heating element base member.

3. A thermal development station according to claim 2 wherein means are provided for preventing heat conduction between the thermally isolated member and the heated base member of the heating element.

4. A thermal development station according to claim 3 wherein the non-heated extension of the heating element base member is separated from the heated base member by a gap.

5. A thermal development station according to claim 1 wherein the thermally isolated member comprises a member resiliently pressed against the drum.

6. A thermal development station according to claim 5 wherein the heating element base member and the resiliently pressed member engage with one another with cooperating indentations at the drum surface.

7. A thermal development station according to claim 5 wherein the resiliently pressed member comprises a plate rotatably seated alongside a leading edge of the heating element base member.

8. A thermal development station according to claim 1 wherein the drum and a leading edge portion of the thermally isolated member forms a wedge-shaped recording material entry aperture.

9. A thermal development station according to claim 1 wherein the thermally isolated member has cooling ribs.

10. A thermal development station according to claim 1 wherein a coefficient of friction between the drum and the recording material between the thermally isolated member and drum is greater than a coefficient of friction between the recording material and the thermally isolated member at the same location.

11. The station of claim 1 wherein means are provided for resiliently pressing the thermally isolated member against the curved surface of the drum for exerting a pressure onto the recording material to allow friction engagement between the recording material and the drum sufficient to overcome undesirable adhesion of the recording material to the heating element base member directly heated portions during processing.

* * * * *